US007564684B2

(12) United States Patent
Luo

(10) Patent No.: US 7,564,684 B2
(45) Date of Patent: Jul. 21, 2009

(54) FAN WITH SPIRAL SUPERCHARGING DEVICE

(75) Inventor: Shi-Ping Luo, Kaohsiung (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 271 days.

(21) Appl. No.: 11/613,358

(22) Filed: Dec. 20, 2006

(65) Prior Publication Data

US 2008/0152502 A1 Jun. 26, 2008

(51) Int. Cl.
*H05K 7/20* (2006.01)

(52) U.S. Cl. ..... 361/695; 361/696; 415/176; 415/188; 416/240; 416/243; 165/80.3

(58) Field of Classification Search ..... 361/690–697, 361/702–712; 165/80.3, 104.33, 185, 121, 165/122, 124; 415/176, 211.2, 208.2, 220, 415/221, 196, 204, 122.1, 124.2, 175, 177, 415/178, 214.1, 209.2, 209.3, 915, 213.1, 415/219.1; 416/176, 137, 188, 240, 223 R, 416/243, 201 A, 198 R, 177, 228, 247 R, 416/354, 423.1

See application file for complete search history.

(56) References Cited

U.S. PATENT DOCUMENTS 1,821,484 A * 9/1931 Spencer ..... 416/202
1,957,237 A * 5/1934 Upson ..... 416/243
2,056,547 A * 10/1936 Weber ..... 416/188
2,123,146 A * 7/1938 Preston ..... 416/240
2,956,739 A * 10/1960 Tothill ..... 416/137
6,886,627 B2 * 5/2005 Kozyra et al. ..... 165/80.3
6,902,377 B2 * 6/2005 Crocker ..... 416/223 R
6,908,282 B2 * 6/2005 Yu ..... 415/211.2
6,910,862 B2 * 6/2005 Horng et al. ..... 415/211.2
7,201,562 B2 * 4/2007 Liu et al. ..... 415/176
7,443,073 B2 * 10/2008 Tung et al. ..... 310/254

FOREIGN PATENT DOCUMENTS

JP 02006105122 A * 4/2006

* cited by examiner

*Primary Examiner*—Michael V Datskovskiy

(57) ABSTRACT

A fan with supercharging device has a hub and fan blades. A hub has a shape similar to a cone with a tip end and a circumferential side. The fan blades extend radially from the circumferential side of the hub. Each of the fan blades has a joining end being attached to the circumferential side, a free end extending outward the hub and a front edge and a rear edge being between the joining end and the free end respectively. The rear edge of the respective fan blade is shielded by the front edge of another fan blade next to it. The unshielded portion of the respective fan blade has an area gradually increases from the joining end to the free end. A projection is disposed at the free end along a direction of fluid flow. Hence, fluid pressure is capable of increasing significantly while the fan is in operation.

2 Claims, 6 Drawing Sheets

FAN WITH SPIRAL SUPERCHARGING DEVICE

BACKGROUND OF THE INVENTION

1. Field of the Invention

The present invention is related to a fan with spiral supercharging device and particularly to a device capable of increasing pressure of fluid outward the fan.

2. Brief Description of the Related Art

Referring to FIGS. 1 and 2, the conventional fan provides a hub 11 and a plurality of fan blades 12. The hub 11 is cylindrical with a flat facial end 111 having an area identical to the rear end thereof. The fan blades 12 surrounding the hub 11 each have a front edge 121 and a rear edge 122 with a gap 13 between every two adjacent fan blades 12, that is, the respective fan blade 12 is unshielded with another fan blade 12 next to it.

The problem of the preceding conventional fan is in that when the fan is in operation, the gap 13 becomes flow passage and fluid can pass outward through the gap 13. However, the fluid being acted by the fan blades 12 becomes less and it leads to pressure of the fluid moving outward being small. In addition, the fluid flows axially and diffuses outward immediately instead of gathering as a fluid beam moving outward.

SUMMARY OF THE INVENTION

In order to solve the preceding problem, an object of the present invention is to provide a fan with spiral supercharging device in which the fan blades overlap partly to each other and a projection is arranged at the free end of the respective fan blade along a direction of fluid flow for increasing fluid pressure and guiding fluid flowing toward the hub.

Another object of the present invention provides a fan with spiral supercharging device in which the hub has a shape similar to a cone with a tip end thereof disposed at the bottom of the fan facing a hot object and a circumferential side has a concave outward curved surface to guide fluid moving the center of the hot object.

Accordingly, a fan with spiral supercharging device according to the present invention has a hub and a plurality of fan blades. A hub has a shape similar to a cone with a tip end and a circumferential side. The fan blades extend radially from the circumferential side of the hub. Each of the fan blades has a joining end being attached to the circumferential side, a free end extending outward the hub and a front edge and a rear edge being between the joining end and the free end respectively. The rear edge of the respective fan blade is shielded by the front edge of another fan blade next to it. The unshielded portion of the respective fan blade has an area gradually increases from the joining end to the free end. A projection is disposed at the free end along a direction of fluid flow.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
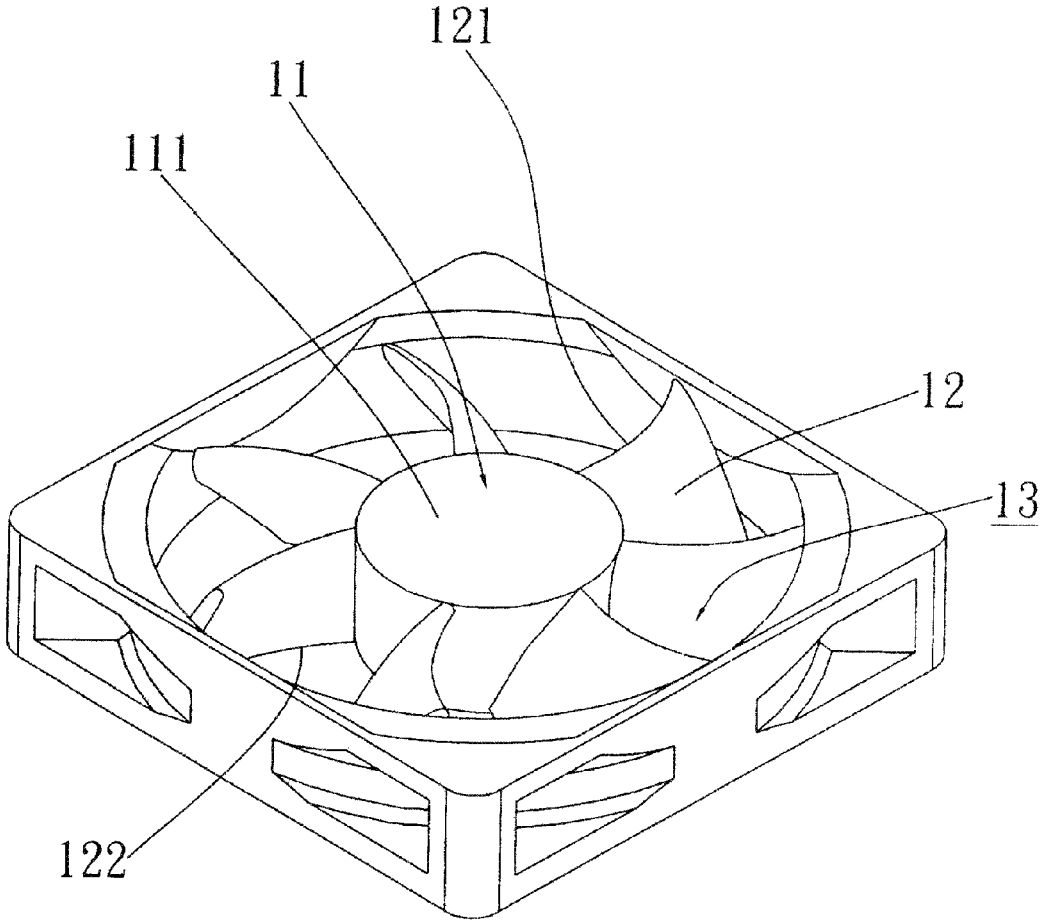
FIG. 1 (Prior Art)
FIG. 1 is a perspective view of the conventional fan.
Figure 2:
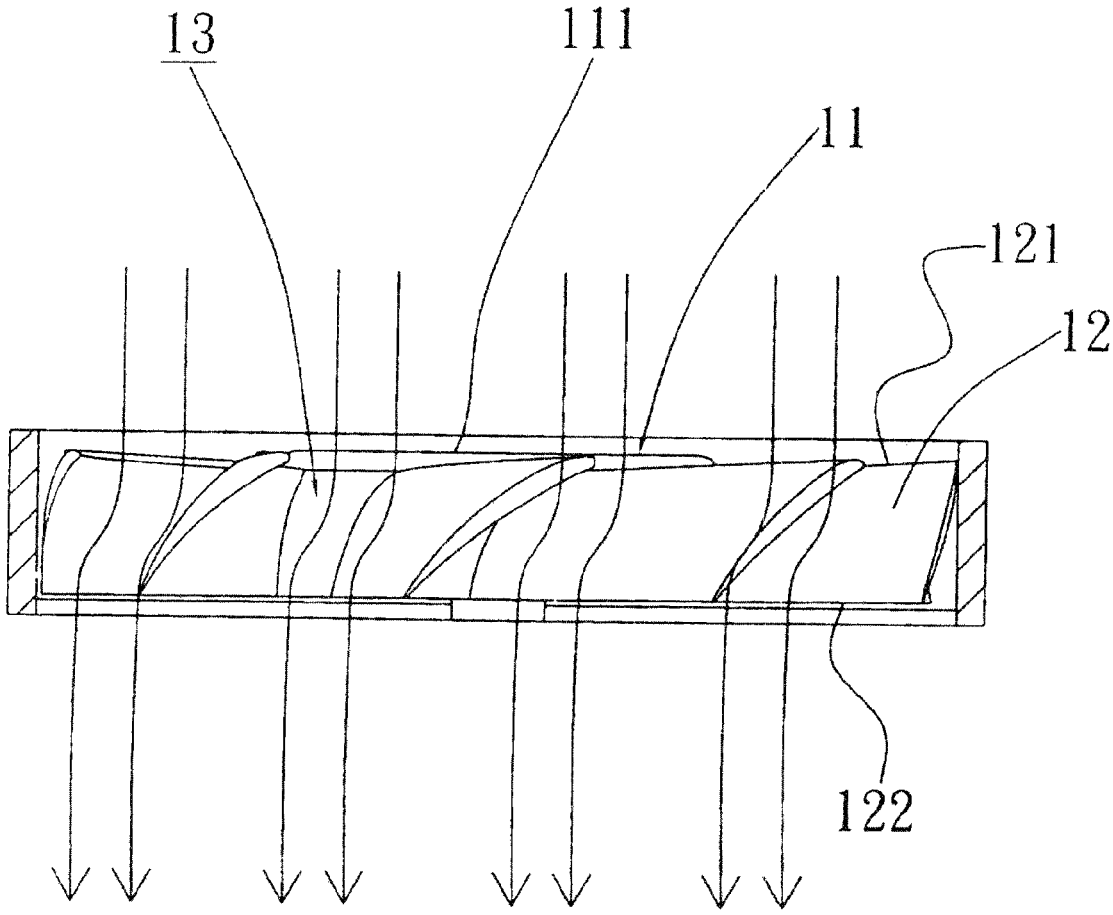
FIG. 2 (Prior Art)
FIG. 2 is a sectional view of the conventional fan shown in FIG. 1.
Figure 3:
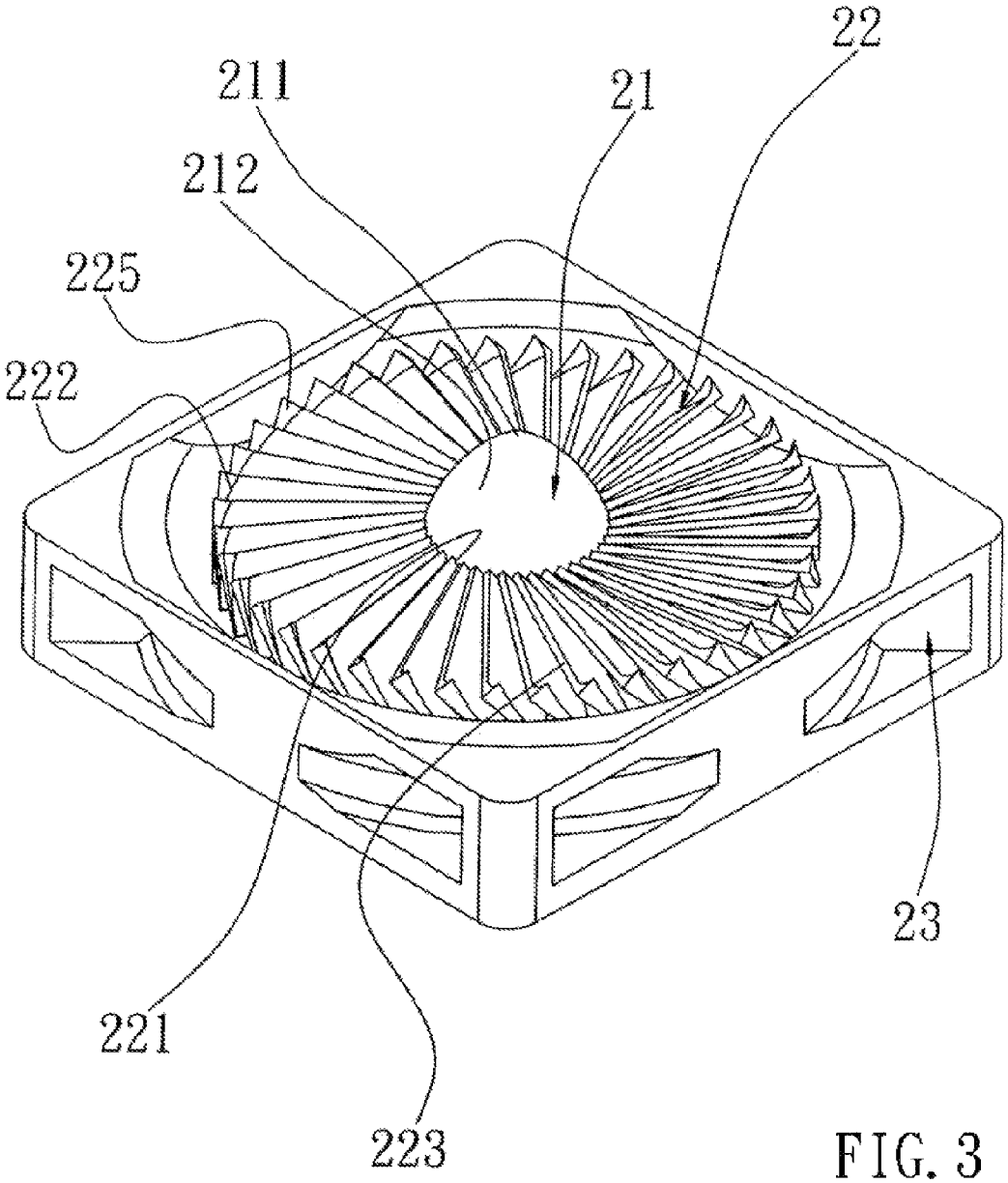
FIG. 3 is a perspective view of a fan with spiral supercharging device according to the present invention.
Figure 4:
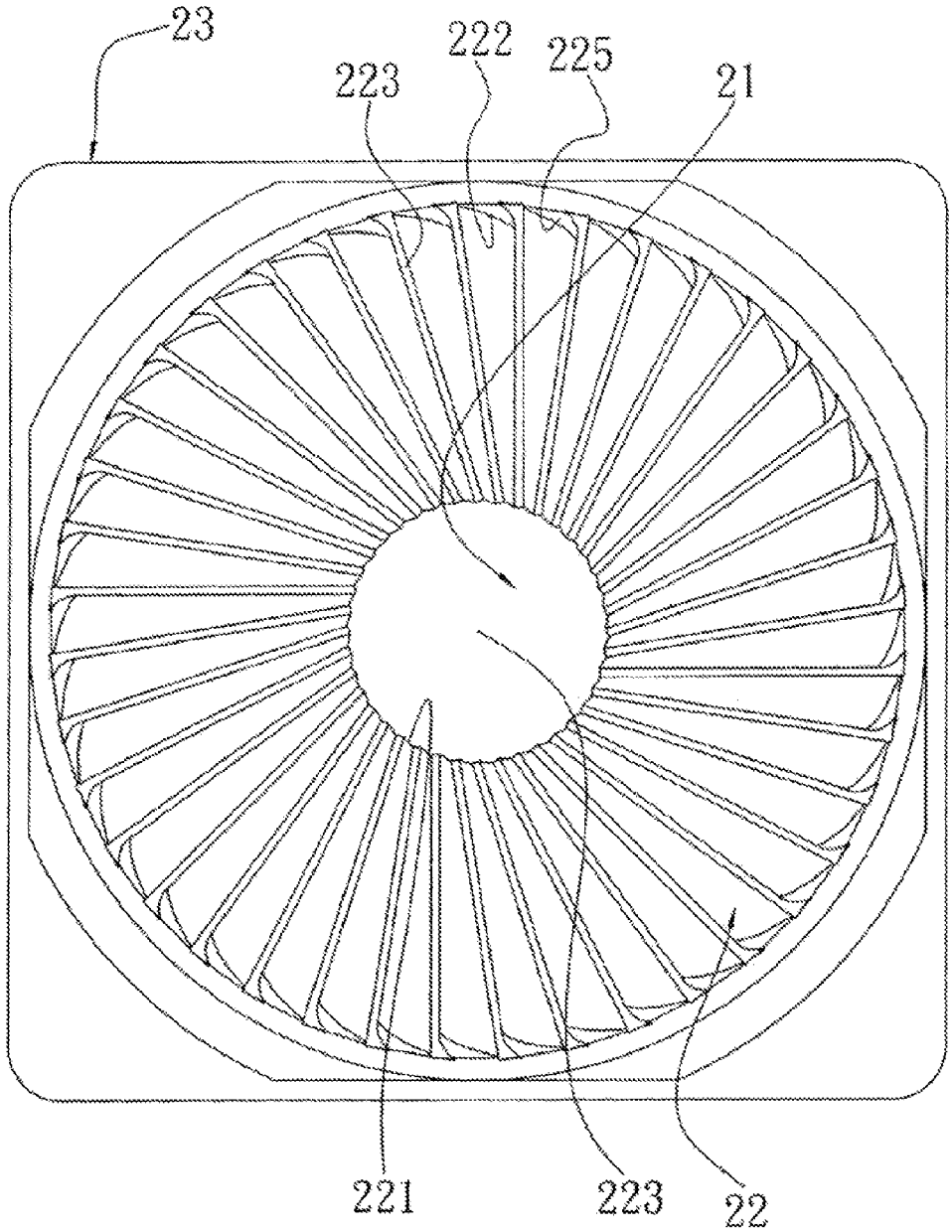
FIG. 4 is a top view of the fan shown in FIG. 3.
Figure 5:
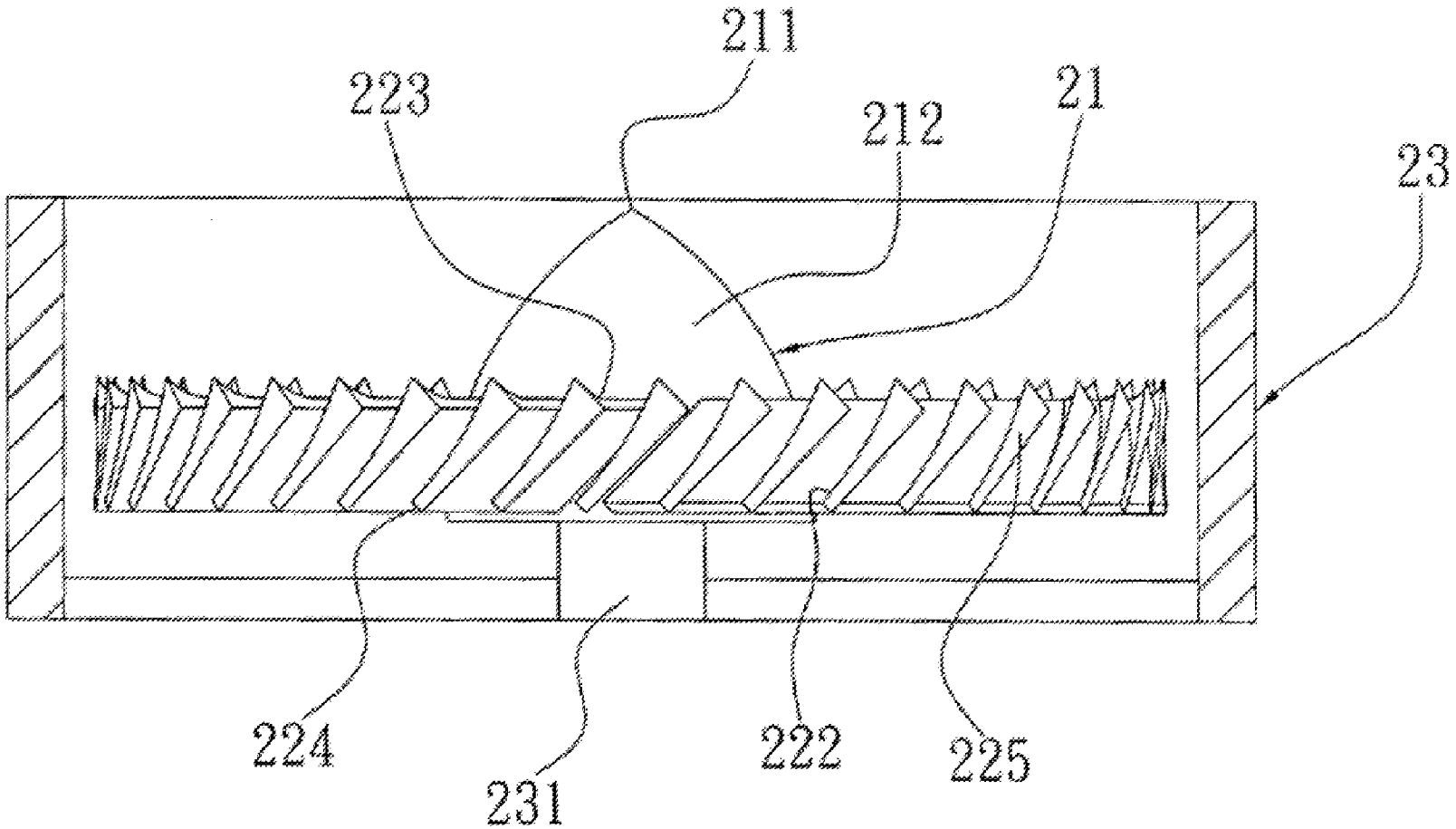
FIG. 5 is a sectional view of the fan shown in FIG. 3.

Referring to FIGS. 3 and 5, a fan with spiral supercharging device according to the present invention includes a hub 21 and a plurality of fan blades 22. The hub 21 has a shape similar to a cone with a central tip 211. The circumferential side 212 of the hub 21 is a concave outward curved surface.

Each of the fan blades 22 has a joining end 221 and a free end 222, a front edge 223 and a rear edge 224 as shown in FIG. 5. The joining end 221 is fixedly attached to the circumferential side 212 of the hub 21 and free end 222 extends outward the hub 21. The front edge 223 and the rear edge 224 are two radial sides of the respective fan blade 22. The rear edge 224 of each fan blade is shielded by the front edge 223 of another fan blade next to it and the unshielded part of the respective fan blade has a width increasing gradually from the joining end 221 to the free end 222. Hence, the respective fan blade 22 has a spiral shape.

A projection 225 is disposed at the free end 222 of the respective fan blade 22 to correspond to direction of the fluid flow and to be perpendicular to the main body of the respective fan blade 22. The hub 21 with the fan blades 22 movably fits with a base 231 in the fan frame 23.

When the hub 21 with the fan blades 22 rotates, fluid is driven to pass a space between every two fan blades 22. The unshielded area of the respective fan blade 22 is small near the joining end 221 such that fluid passes the small unshielded area subjects to small acting force and it results in less pressure while the unshielded area of the respective fan blade 22 near the free end 222 is large such that the fluid passes the large unshielded area subjects to large acting force and it results in more pressure. That is, small fluid pressure is close to the joining end 221 and large fluid pressure is close to the free end 222. The fluid with large pressure usually flows toward the fluid with small pressure such that the fluid passes the free end 222 moves toward the joining end 221. Under this circumference, the fluid flowing outward via the fan blades 22 is capable of congregating at the joining end 221 before leaving the fan blades 22 and preventing from diffusing outward.

Furthermore, the projection 225 at the free end of the respective fan blade 22 is capable of hitting the fluid near the free end 222 and allowing the fluid to change original flowing direction and move toward the joining end 221.

Figure 6:
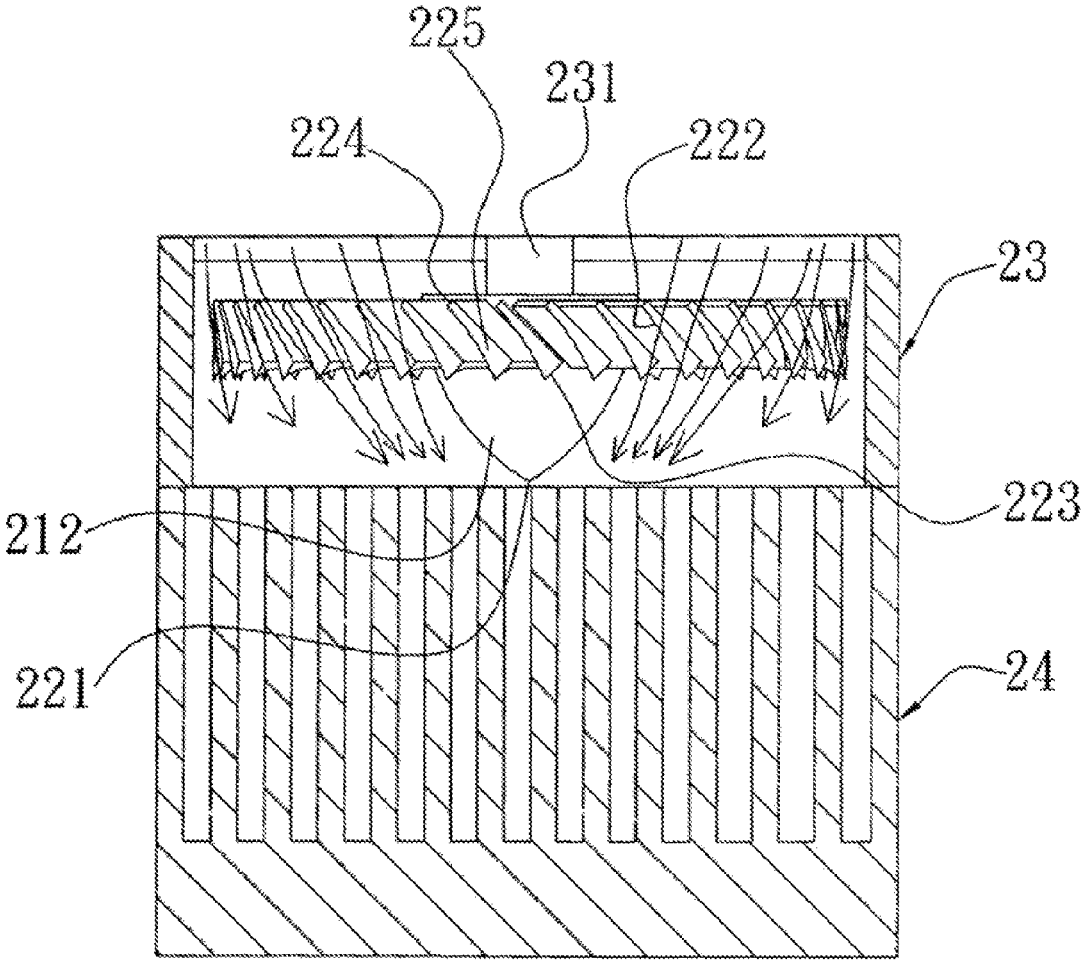
FIG. 6 is a sectional view illustrating the fan with a spiral supercharging device according to the present invention being attached to a heat sink.

Referring to FIG. 6 in company with FIG. 3, the fan frame 23 is mounted to a hot object 24 in a way of the tip 211 of the hub 21 being next to the central position of the top of the heat sink 24. The hot object 24 can be a heat sink or a central processing unit (CPU). Once the hub 21 with the fan blades 22 is driven to rotate, fluid is induced by the fan blades 22 to enter the fan frame via the side having the base 231 and then flow outward via another side of the fan frame toward the heat sink 24. The fluid passing the fan blades 22 can gather at the joining end 221 of the respective fan blade 22 and moves along the circumferential side of the hub 21 to the tip end 211. Finally, the fluid flows to the center of the heat sink 24 to solve the problem of the center of the heat sink being a zone with highest heat for enhancing efficiency of heat dissipation.

While the invention has been described with referencing to a preferred embodiment thereof, it is to be understood that modifications or variations may be easily made without departing from the spirit of this invention, which is defined by the appended claims.

What is claimed is:

1. A fan with spiral supercharging device comprising:

a hub having a shape similar to a cone with a tip end and a circumferential side; and a plurality of fan blades extending radially from the circumferential side of the hub with each of the fan blades having a joining end being attached to the circumferential side and a free end extending outward the hub and having a front edge and a rear edge being between the joining end and the free end such that the rear edge of the respective fan blade is shielded by the front edge of another fan blade next to it and unshielded portion of the respective fan blade has an area gradually increases from the joining end to the free end;

characterized in that the free end has a projection disposed along a direction of fluid flow.

2. The fan with spiral supercharging device as defined in claim 1, wherein the projection is perpendicular to the corresponding fan blade.

* * * * *